US006705223B2

(12) United States Patent
Schönberger

(10) Patent No.: US 6,705,223 B2
(45) Date of Patent: Mar. 16, 2004

(54) INKING UNIT FOR A PRINTING MACHINE

(75) Inventor: Wolfgang Schönberger, Schriesheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 22 days.

(21) Appl. No.: 10/074,846

(22) Filed: Feb. 12, 2002

(65) Prior Publication Data

US 2002/0108517 A1 Aug. 15, 2002

(30) Foreign Application Priority Data

Feb. 12, 2001 (DE) ..... 101 06 414

(51) Int. Cl.[7] ..... B41F 31/00
(52) U.S. Cl. ..... 101/350.1; 101/367
(58) Field of Search ..... 101/350.1, 350.5, 101/152, 153, 364–367, 363

(56) References Cited

U.S. PATENT DOCUMENTS

| | | | | |
|---|---|---|---|---|
| 2,666,386 A | | 1/1954 | Jovishoff et al. | |
| 3,457,858 A | | 7/1969 | Gibbs | |
| 3,589,288 A | * | 6/1971 | Lake | 101/366 |
| 3,631,800 A | * | 1/1972 | Mignone | 101/366 |
| 4,497,250 A | * | 2/1985 | Dressler | 101/366 |
| 4,901,641 A | * | 2/1990 | Steiner et al. | 101/152 |
| 5,325,775 A | | 7/1994 | Grosshauser et al. | |
| 5,497,700 A | * | 3/1996 | Herb | 101/153 |
| 5,615,611 A | * | 4/1997 | Puschnerat | 101/363 |
| 5,727,463 A | | 3/1998 | Deschner et al. | |
| 5,749,293 A | * | 5/1998 | Ota et al. | 101/350.5 |
| 6,401,612 B2 | * | 6/2002 | Koehler | 101/365 |

FOREIGN PATENT DOCUMENTS

| | | |
|---|---|---|
| DE | 26 25 623 | 12/1977 |
| DE | 42 00 837 C2 | 7/1993 |
| DE | 43 37 386 A1 | 5/1994 |
| DE | 195 25 849 A1 | 1/1997 |
| DE | 196 00 796 A1 | 7/1997 |
| DE | 297 18 387 U1 | 3/1998 |
| EP | 0 955164 A1 | 11/1999 |

* cited by examiner

*Primary Examiner*—Eugene H. Eickholt
(74) *Attorney, Agent, or Firm*—Laurence A. Greenberg; Werner H. Stemer; Ralph E. Locher

(57) ABSTRACT

An inking unit for a printing machine includes at least one roller, an ink container adjacent to the roller, a metering doctor blade disposed on the ink container and being engageable with the roller, and a movable displacer element for setting a printing ink level in the ink container relative to the metering doctor blade.

13 Claims, 8 Drawing Sheets

INKING UNIT FOR A PRINTING MACHINE

BACKGROUND OF THE INVENTION

Field of the Invention

The invention relates to an inking unit for a printing machine, including at least one roller, and a metering doctor blade disposed on an ink container and engageable with the roller.

Inking units of the hereinaforementioned type have become known heretofore. They include at least one roller, for example, a screen roller with cells located on the outer cylindrical or jacket surface thereof for accepting printing ink, and a metering doctor blade which, for example, is used for doctoring the printing ink off the roller jacket. The metering doctor blade is attached to an open ink container. During the operation of the inking unit, the level of the printing ink in the ink container lies above the tip and knife or cutting edge, respectively, of the metering doctor blade set against the roller jacket, so that, as the roller rotates, the roller jacket dips into the printing ink and is wetted thereby. It is then doctored off with the aid of the metering doctor blade. During an ink change, or in order to clean the ink container and the metering doctor blade, the container and the blade have to be dismantled and removed from the printing machine. A disadvantage regarding the heretofore known open metering doctor blades is that the level of the printing ink in the ink container must lie far above the tip of the metering doctor blade for attaining a reliable filling of the cells of the roller and, therefore, the ink container and the metering doctor blade cannot be dismantled without an at least brief flowing and dripping, respectively, of the printing ink out of the ink container over the tip of the metering doctor blade. Before the metering doctor blade can be lifted off the roller during dismantling, it is necessary, therefore, for the printing ink level in the ink container to be lowered below the tip of the metering doctor blade.

The published German Patent Document DE 297 18 387U1 reveals an ink fountain or duct with a metering doctor blade attached thereto which, during the operation of the inking unit, is located in a 12 o'clock position with respect to the roller. In order to be able to dismantle the ink duct, it is pivoted through 90° into the 3 o'clock position, as a result of which the printing ink stored in the ink duct runs into a channel in the ink duct and is collected therein. The printing ink level in the ink duct consequently falls below the highest point of the metering doctor blade, so that the ink duct can be dismantled without having printing ink run out over the tip of the metering doctor blade.

The published German Patent Document DE 43 37 386 A1 discloses a doctor blade device having an ink container and a metering doctor blade engageable with a roller. Arranged in the ink container are a number of sealing profile strips, which are arranged in an ink chamber containing printing ink, and are adjustable against the roller jacket. In this regard, all of the printing ink is displaced from the ink chamber into a residual space partitioned off from the roller. This occurs at the end of operations or when a temporary operational interruption of the inking unit occurs. The published European Patent Document EP 0 955 164 A1 reveals a similar doctor blade device wherein, in order to empty the ink chamber which is in contact with the outer jacket of the roller, a flexible diaphragm is pressed into the chamber and, in an end position, lies on the roller jacket.

The published German Patent Document DE 26 25 623 A1 discloses a device with an ink container having a wall which is movable linearly in a direction towards a roller and is used for the purpose of exerting pressure on the printing ink in order thereby to counteract the thixotropic behavior of the printing ink and also a nonuniform takeup of the ink from the roller.

SUMMARY OF THE INVENTION

It is accordingly an object of the invention to provide an inking unit of the type mentioned in the introduction hereto wherein the metering doctor blade can be arranged laterally on the roller, and wherein the ink container with the metering doctor blade attached thereto is removable from the roller by the shortest route, without allowing any printing ink to emerge from the ink container in the process.

With the foregoing and other objects in view, there is provided, in accordance with the invention, an inking unit for a printing machine, comprising at least one roller, an ink container adjacent to the roller, a metering doctor blade disposed on the ink container and being engageable with the roller, and a movable displacer element for setting a printing ink level in the ink container relative to the metering doctor blade.

In accordance with another feature of the invention, the displacer element is optionally adjustable into a first position, wherein the level of printing ink stored in the ink container lies above a highest point of the metering doctor blade, and into a second position, wherein the printing ink level in the ink container lies below the highest point of the metering doctor blade.

In accordance with a further feature of the invention, the displacer element is formed by an adjustable rear wall of the ink container.

In accordance with an added feature of the invention, the rear wall is pivotably mounted.

In accordance with an additional feature of the invention, the rear wall is pivotably mounted on a base body carrying the metering doctor blade.

In accordance with yet another feature of the invention, the pivotable mounting is on a pivot axis located below a highest point of the metering doctor blade.

In accordance with yet a further feature of the invention, the rear wall has a crank-shaped course.

In accordance with yet an added feature of the invention, in the first position thereof, the displacer element is at least partly immersed in the printing ink stored in the ink container, and in the second position thereof, is lifted completely out of the stored printing ink.

In accordance with yet an additional feature of the invention, the displacer element is pivotable about a pivot axis disposed above a bottom of the ink container.

In accordance with still another feature of the invention, the displacer element has an outer contour matched to an inner contour of the ink container so that a height of a gap formed between at least one of an ink container rear wall and an ink container bottom, on the one hand, and the displacer element moved into an end position, on the other hand, is very small.

In accordance with still a further feature of the invention, the metering doctor blade, in a position thereof wherein it is in engagement with the roller, is disposed, in relation to the roller, below an upper apex and above a lower apex of the roller.

In accordance with still an added feature of the invention, the metering doctor blade is disposed in a region of the roller between 7 o'clock and 11 o'clock positions thereon.

In accordance with still an additional feature of the invention, as viewed in the direction of rotation of the roller, at least one further doctor blade is disposed upline from the metering doctor blade, the further doctor blade being settable in engagement with the roller and serving as a wiper for at least one of air and printing ink.

In accordance with a concomitant feature of the invention, the ink container is trough-shaped, and a cover is disposed on the ink container for closing the ink container.

In order to attain the object of the invention, there is therefore provided an inking unit having a movable displacer element for setting the printing ink level in the ink container relative to the metering doctor blade. With the aid of the displacer element, it is readily possible, as required, to lower the level of the liquid or pasty printing ink in the ink container below the highest point of the metering doctor blade set against or in engagement with the roller. The ink container and the metering doctor blade can then be removed from the roller by a direct route, without allowing printing ink to flow or drip out of the ink container over the tip of the metering doctor blade.

In conjunction with the invention of the instant application, "setting the metering doctor blade" onto or into engagement with the roller is understood to mean that the metering doctor blade rests with the tip or cutting edge thereof on the roller cover or is pressed against the latter, so that printing ink located on the roller jacket can be doctored off, or that the metering doctor-blade tip/cutting edge is disposed at a short distance from the roller outer cylindrical or jacket surface, so that a printing ink film with a thickness defined by the gap remains on the roller jacket or a printing material transferred by the latter, for example, a sheet.

When installed in the inking unit, the ink container with the metering doctor blade attached thereto is preferably disposed laterally beside the roller, so that in order to make ready for removal of the ink container from the inking unit and the printing machine, respectively, it is necessary only for the printing ink level to be lowered below the tip of the metering doctor blade, it being possible to dispense with pivoting the ink container into a removal/emptying position, as required in heretofore known devices of this general type. A further advantage of the invention is that the ink container can be removed from the inking unit even with a full printing ink content, for example when production is interrupted, without allowing printing ink to run out in the process. The maximum filling quantity of the ink container, at least when the ink container is being removed, is therefore only sufficiently large so that, at the greatest possible volume of the ink container, which is provided by appropriately positioning the displacer element, the printing ink level lies below the tip of the metering doctor blade.

In a preferred embodiment, the displacer element can be adjusted optionally or selectively into a first position, wherein the level of the printing ink stored in the ink container lies above a highest point of the metering doctor blade, and into a second position, wherein the printing ink level in the ink container lies below the highest point of the metering doctor blade. The first and the second positions can be end positions, the displacer element preferably being adjustable into virtually any desired number of intermediate positions, i.e., infinitely or continuously, or into a limited number of intermediate positions, for example, in a fixed grid or pattern. The configuration according to the invention of the displacer element allows, at least approximately, emptying of the ink container completely, it being possible to ensure a desired inking of the roller even with a minimum quantity of ink in the ink container.

Other features which are considered as characteristic for the invention are set forth in the appended claims.

Although the invention is illustrated and described herein as embodied in an inking unit for a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
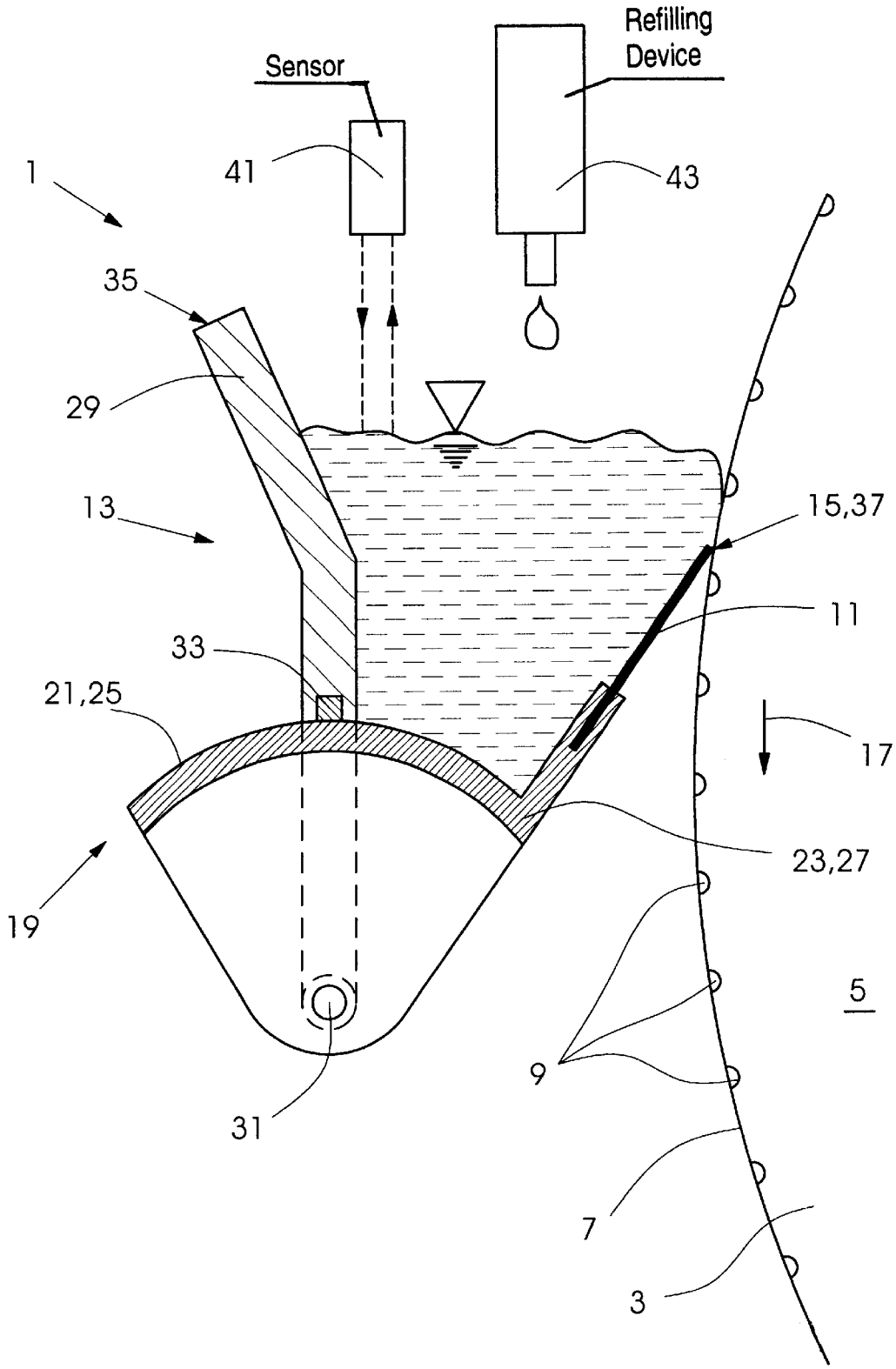
FIGS. 1 to 3, respectively, are a fragmentary diagrammatic sectional view, in different operating phases, of an exemplary embodiment of the inking unit according to the invention, wherein a displacer element is shown moved into various positions.

Referring now to the drawings and, first, particularly to FIGS. 1 to 7 thereof, there is shown therein an inking unit 1 such as has been described hereinabove, which can be used generally in conjunction with a printing machine, for example a rotary printing machine. The inking unit 1 includes at least one roller 3 which, in the exemplary embodiments illustrated in FIGS. 1 to 7, is formed by a screen roller 5. On the outer or jacket surface 7 thereof, the screen roller 5 is formed with depressions or cells 9 for holding printing ink therein. The construction and the function of the screen roller 5 are well known, so that they will not be discussed in any greater detail herein.

FIG. 1 shows a first exemplary embodiment of the inking unit 1 which, in addition to the screen roller 5, includes a metering doctor blade 11, which is disposed on or attached to an ink receptacle or container 13. The metering doctor blade 11, attached in a fixed position to the ink container 13, is constructed like a knife and extends in the longitudinal direction of the screen roller 5, as does the ink container 13. In FIG. 1, the metering doctor blade 11 is set against the outer jacket surface 7 of the screen roller 5, i.e., the tip 15 of the metering doctor blade 11 lies on the outer jacket surface 7 and doctors the printing ink off the screen roller 5. The direction of movement of the outer jacket surface 7 of the screen roller 5 is represented by an arrow 17.

The ink container 13 is of trough-type construction, i.e., it is open at the top and has a base body 19 which, as viewed in cross section, has a first wall 21 that is curved convexly with respect to an imaginary horizontal, and a second wall 23 which originates from the first wall 21 and extends in a direction towards the outer cylindrical or jacket surface 7 of the screen roller 5. The first wall 21 forms the bottom 25, and the second wall 23 forms the front wall 27 of the ink container 13. The metering doctor blade 11 is disposed on the front wall 27 and, in effect, forms an extension thereof. The ink container 13 also has a rear wall 29, which is somewhat crank-shaped. The ink container 13 also has side walls extending parallel to the plane of the drawings of the figures, but not illustrated therein.

In the exemplary embodiment shown in FIG. 1, the rear wall 29 is pivotable in and counter to the clockwise direction about a pivot axis 31 located on the base body 19. Here, the pivot axis 31 runs at least approximately parallel to the longitudinal axis of the screen roller 5. A sealing strip 33 prevents printing ink from emerging between the adjustable rear wall 29 and the stationary base body 19. Also provided are non-illustrated lateral seals, which serve to seal off the gaps formed between the movable rear wall 29 and the non-illustrated stationary side walls.

The rear wall 29 is pivotable stepwise into various positions, for example, due to the latching of a non-illustrated latch pin into various holes, or else infinitely variably or continuously, the rear wall 29 being locked, for example, by a clamping fastening, in the case of an infinitely variable adjustment. The rear wall 29 is pivotable manually or by an actuating device having a drive. These aforementioned devices are not illustrated.

The respectively adjustable and pivotable rear wall 29 forms a displacer member 35, by the aid of which the printing ink level in the ink container 13 can be set relative to the metering doctor blade 11. In the case of a high printing-ink level, therefore, the depth of the printing-ink bath in the ink container 13 is greater than in the case of a comparatively lower printing-ink level. By pivoting the displacer elements 35 about the pivot axis 31, the volume of the ink container 13 is changed, so that with a constant filling volume in the ink container 13, the level of the ink container 13 changes, as will be explained in greater detail hereinbelow.

In FIG. 1, the displacer element 35 is in a first position, wherein the level of the printing ink stored in the ink container 13 is located above the highest point 37 of the metering doctor blade 11 lying against or in engagement with the outer jacket surface 7. The highest point 37 here is formed by the tip 15 of the metering doctor blade 11. To make ready for removing the ink container 13 from the inking unit 1 and from the printing machine, respectively, the displacer element 35 is moved in a counterclockwise direction into a second position illustrated in FIG. 2, due to which the volume of the ink container 13 increases, which causes the printing ink level in the ink container 13 to fall below the highest point 37 of the metering doctor blade 11. Then, as represented by the arrow 39, the ink container 13 can be taken directly out of the inking unit 1 laterally, i.e., parallel to the imaginary horizontal, without allowing printing ink to drip over the tip 15 of the metering doctor blade 11 into the inking unit 1 and the printing machine, respectively, in the process. Of course, it is also possible to remove the ink container 13 from the inking unit 1 in a vertical direction, downwardly or, if appropriate, upwardly.

As the printing ink level in the ink container 13 is lowered, the screen roller 5 preferably rotates further, so that the printing ink initially yet adhering to the outer jacket surface 7 of the screen roller 5 is wiped off on the metering doctor blade 11. After the ink container 13 with the metering doctor blade 11 disposed thereon has been dismantled, the screen roller 5 is therewith also doctored off cleanly. There is still only printing ink in the cells 9. Thus, at any time, for example, even after production has been interrupted, the ink container 13 can be dismantled with the complete printing-ink content thereof. It can be stored temporarily, just as it is, and if necessary can be inserted again later and reused.

Figure 3:
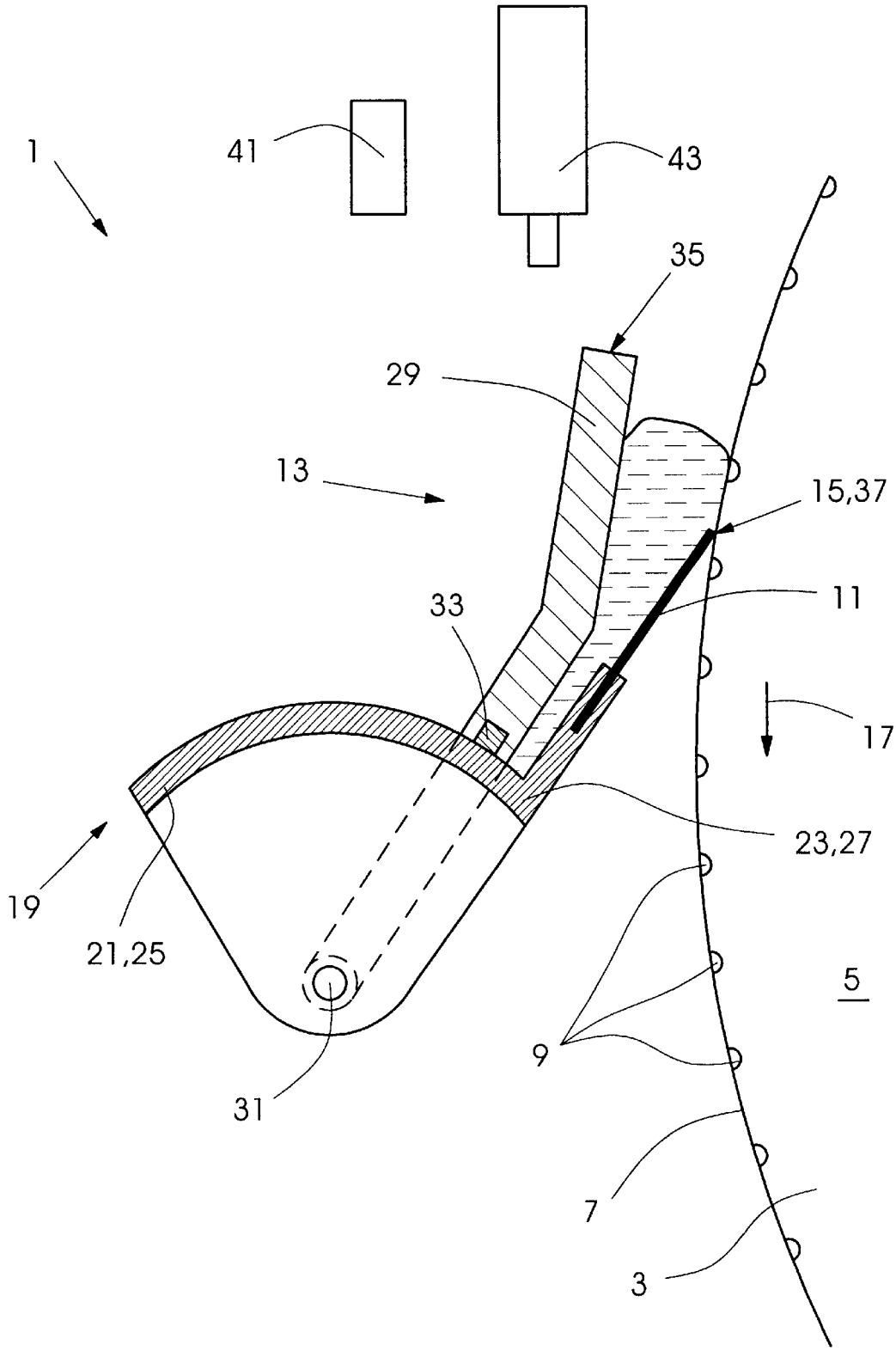

If, towards the end of a production, it is desired to use up the printing ink supply in the ink container 13 as much as possible, the printing ink in the ink container 13 can be forced against the outer jacket surface 7 of the screen roller 5 by pivoting the displacer element 35 in the direction towards the screen roller 5. In FIG. 3, the displacer element 35 is illustrated in a third position, which here is an end/stop position, wherein it tends to strike the front wall 27 of the ink container 13. The volume of the container 13 is then a minimum. Because of the mutually matching shape of the rear wall 29 and of the front wall 27, virtually all of the printing ink is displaced out of the ink container 13 into the space bounded or defined by the metering doctor blade 11, the rear wall 29 and the outer jacket surface 7 of the screen roller 5. It is believed to be apparent from FIG. 3 that, with the aid of the adjustable displacer element 35, the printing ink level can be kept above the highest point 37 of the metering doctor blade 11 even with only very little printing ink in the ink container 13, so that the screen roller 5 is inked in the desired way. It is thereby possible to ensure that only very little residual ink accumulates after the ink container 13 has been dismantled.

Figure 2:
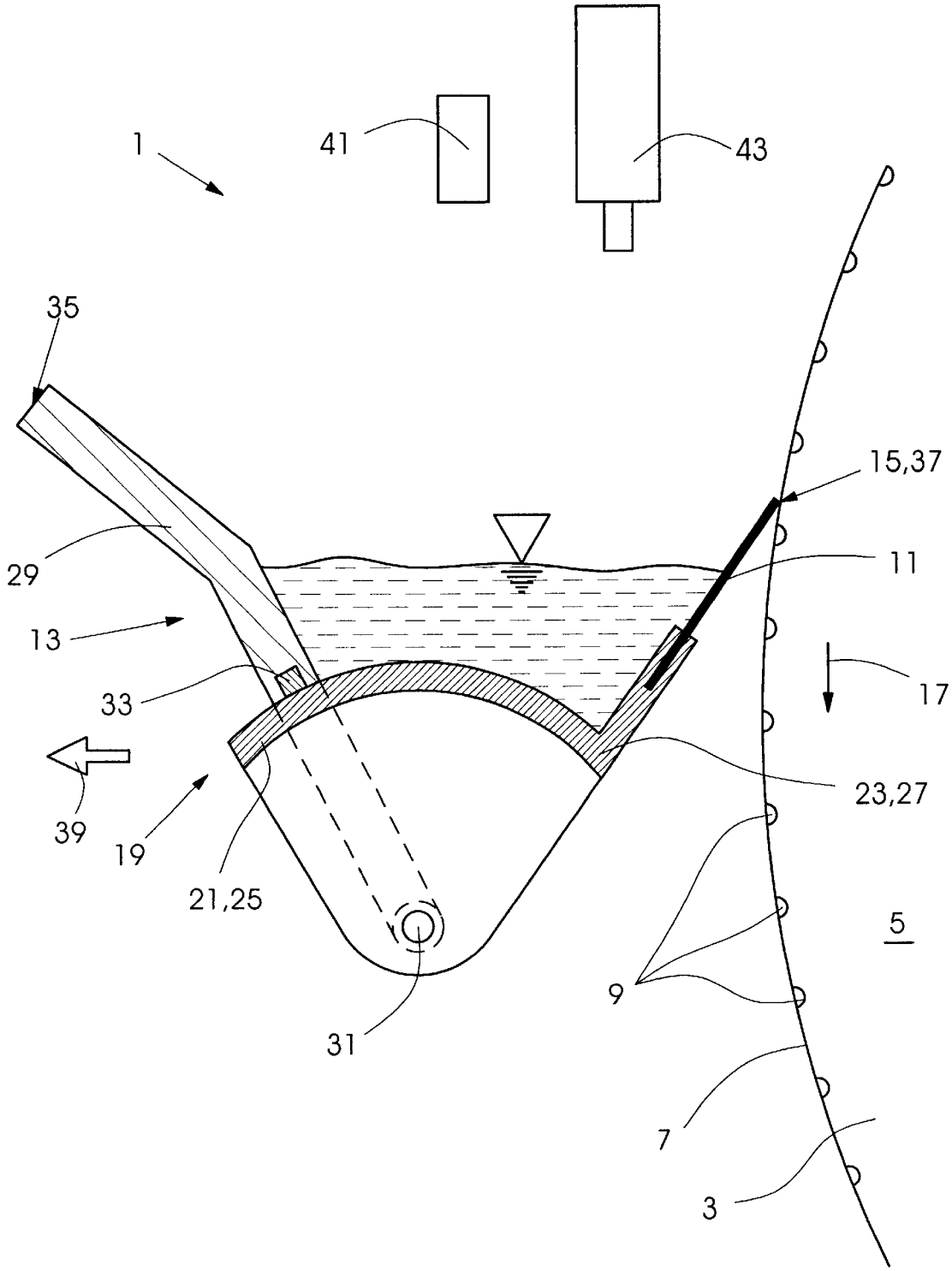

In the exemplary embodiment of the inking unit 1 described hereinbefore with respect to FIGS. 1 to 3, a sensor 41 for registering the printing ink level and the filling height, respectively, of the ink container 13 is provided above the upwardly open ink container 13, and a refilling device 43 for the automatic filling and refilling, respectively, of the ink container 13 is provided. The refilling device 43 can be formed, for example, by a cartridge.

Figure 4:
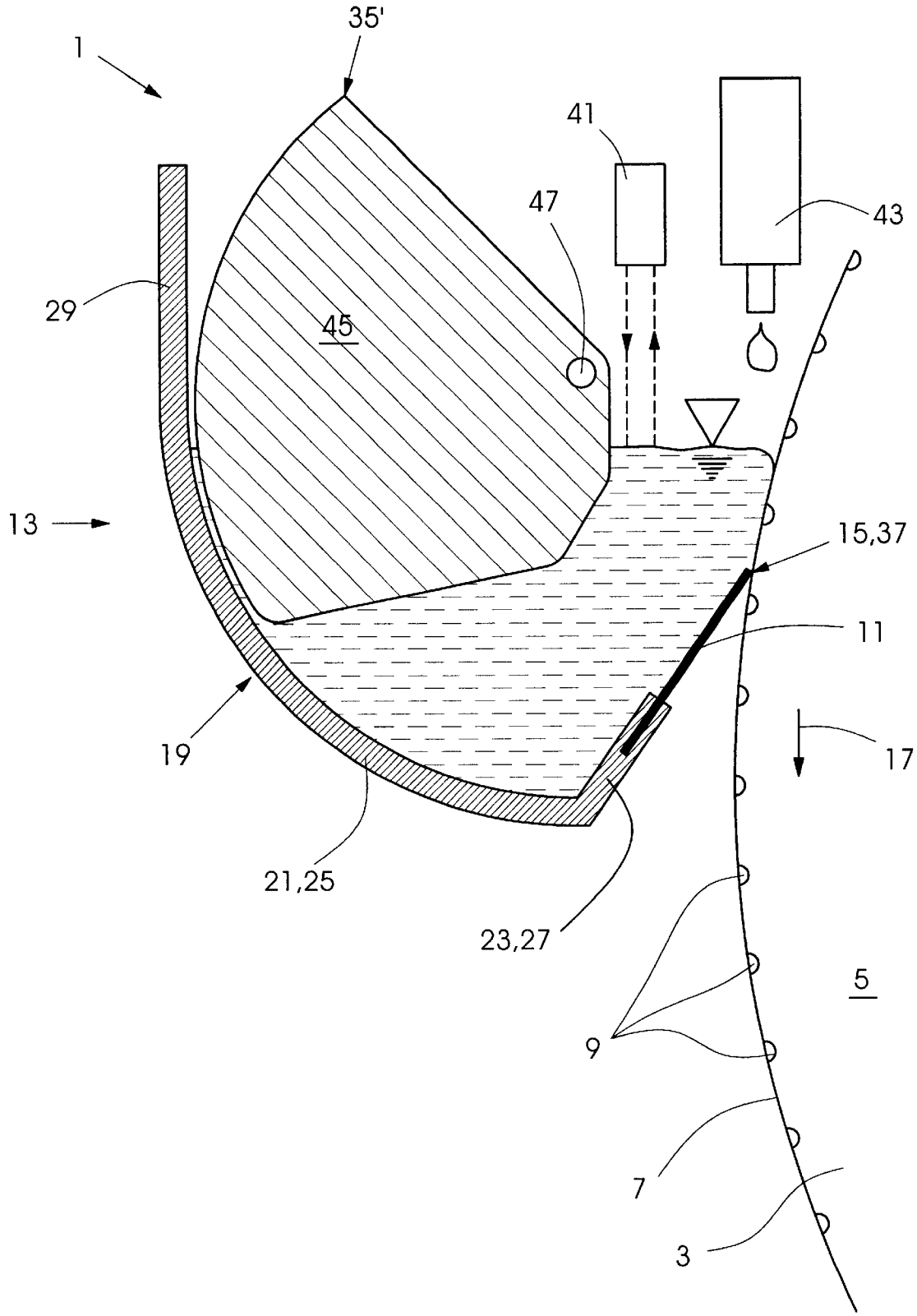
FIGS. 4 to 6, respectively, is a view like that of FIGS. 1 to 3 of another exemplary embodiment of the inking unit, in different operating phases, wherein the movable displacer element located in various positions is of different construction.
Figure 5:
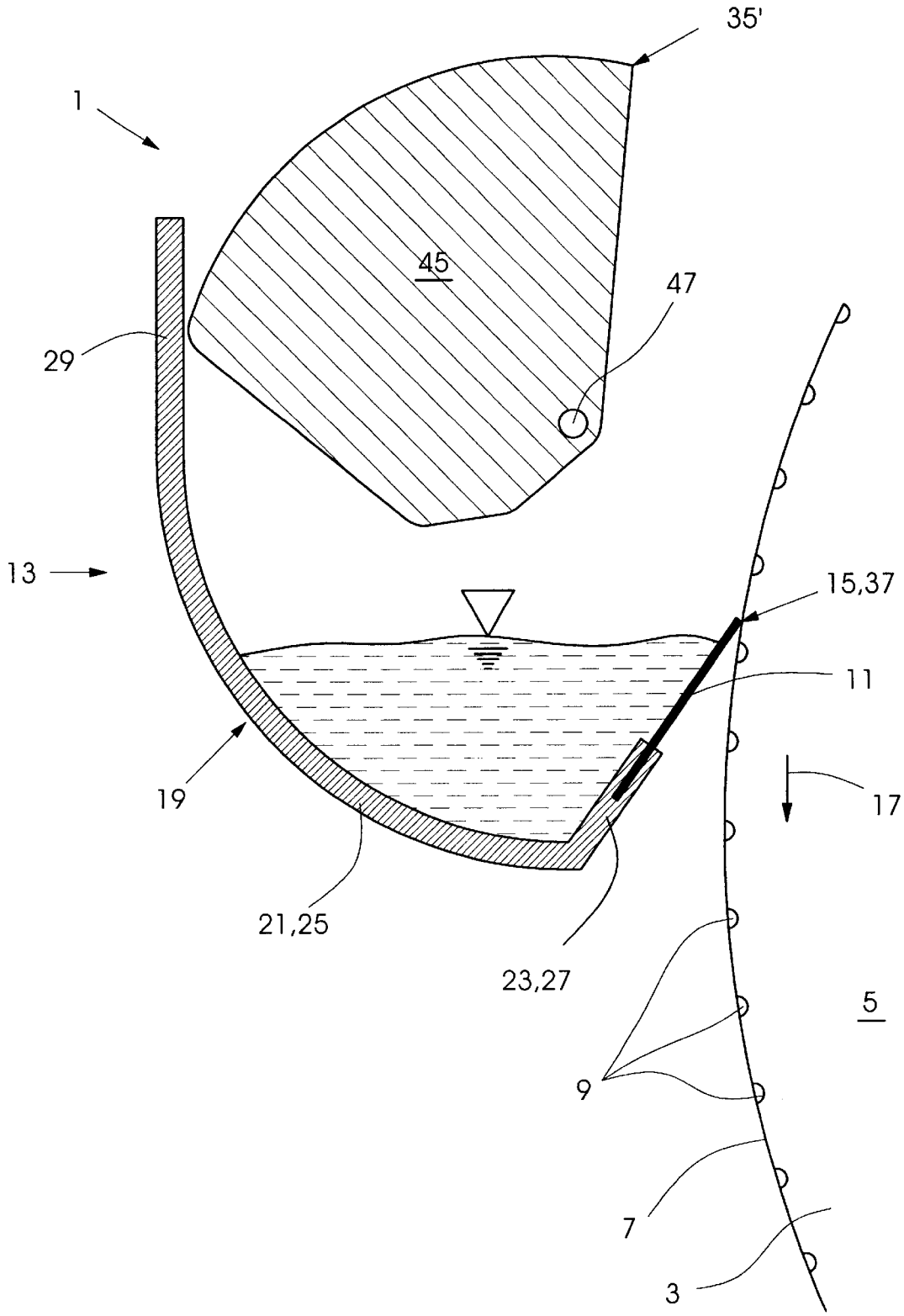
Figure 6:
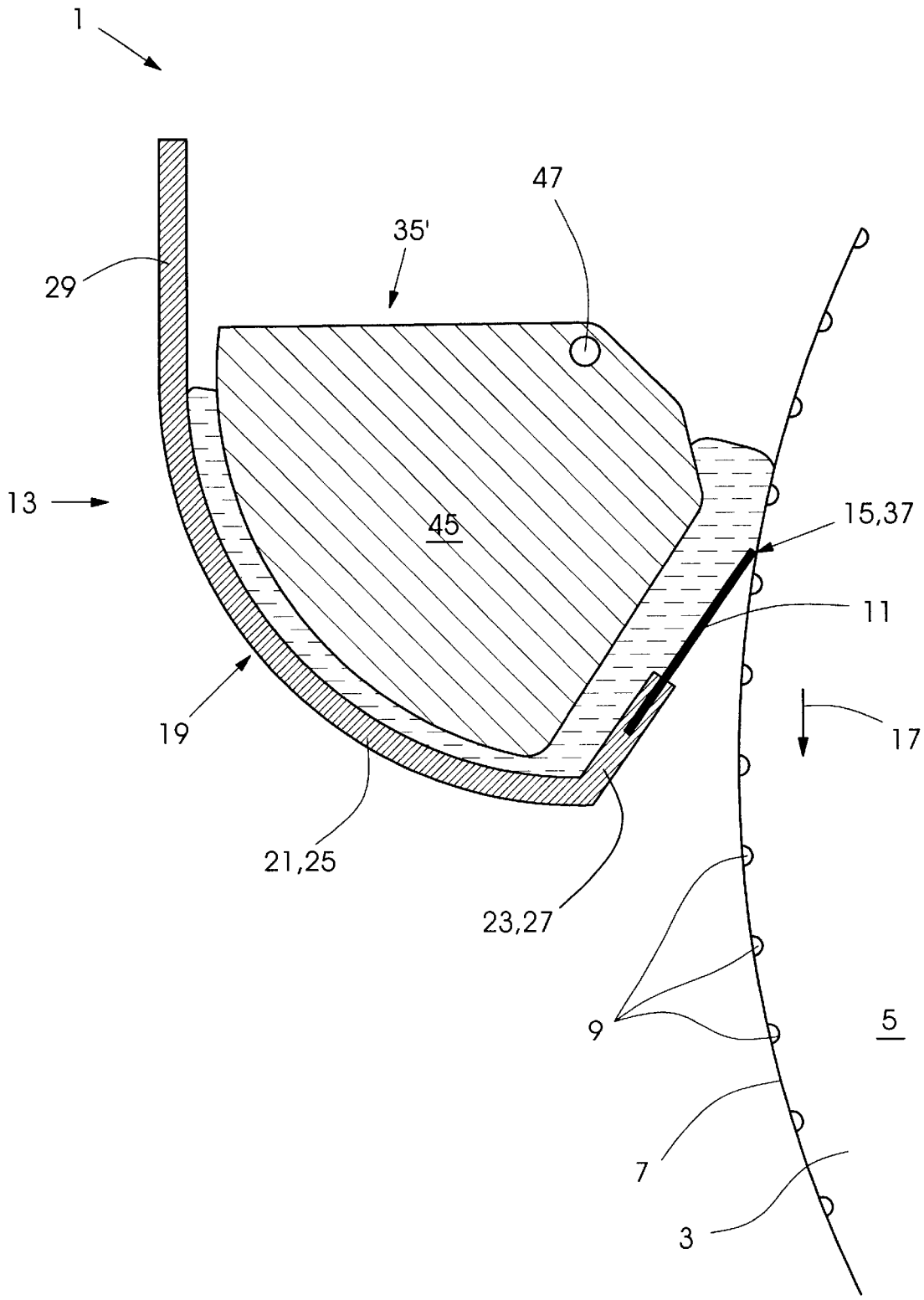

FIGS. 4 to 6 show a further exemplary embodiment of the inking unit 1. Identical parts have been identified by the same reference numerals, so that to this extent reference may be made to the description relating to the preceding FIGS. 1 to 3. In the following text, only the differences will be described in greater detail.

As is apparent from FIG. 4, the rear wall 29, the bottom 25 and the front wall 27 of the ink container 13 are formed in one piece. No movable seals for sealing off the ink container 13 with respect to the environment are therefore needed. However, seals are required between the non-illustrated side walls of the ink container and the rear wall, front wall and bottom, if the side walls do not have a material connection with the remaining container walls.

In the exemplary embodiment illustrated in FIGS. 4 to 6, the displacer element 35' is formed by a submersible or immersion element 45, which is pivotably mounted. The pivot axis 47 extends parallel to the axis of rotation of the screen roller 5 and, with the aid of a non-illustrated holding device above the container bottom 25 and outside the printing ink bath, is held in a fixed location.

In the first position of the immersion element 45 illustrated in FIG. 4, it is partly submerged in the printing ink present in the ink container 13, due to which a printing ink level is set which lies above the highest point 37 of the metering doctor blade 11. By pivoting the immersion element 45 in clockwise direction about the pivot axis 47, the immersion element 45 is moved into a second position illustrated in FIG. 5, wherein it is lifted completely out of the printing ink bath in the ink container 13. The printing ink level in the ink container 13 consequently falls below the tip 15 of the metering doctor blade 11, so that the ink container 13 can readily be dismantled without allowing printing ink to run out of the ink container 13 over the metering doctor blade 11 after the metering doctor blade 11 has been lifted off the roller jacket 7.

In FIG. 6, the immersion element 45 is shown in a third position, wherein it is completely submerged in the ink container 13. Because of the arrangement and shape of the immersion element 45, the major part of the printing ink is displaced out of the ink container 13 onto the screen roller 5 by the immersion element 45. The ink container 13 can also be emptied virtually forcibly in this exemplary embodiment.

It is apparent from FIG. 6 that the outer contour of the immersion element 45 is matched to the inner contour of the ink container 13 in a manner that the height of the gap formed between the rear wall 29 and the bottom 25 of the ink container 13, on the one hand, and the immersion element 45 moved into an end position, on the other hand, is only very small.

Figure 7:
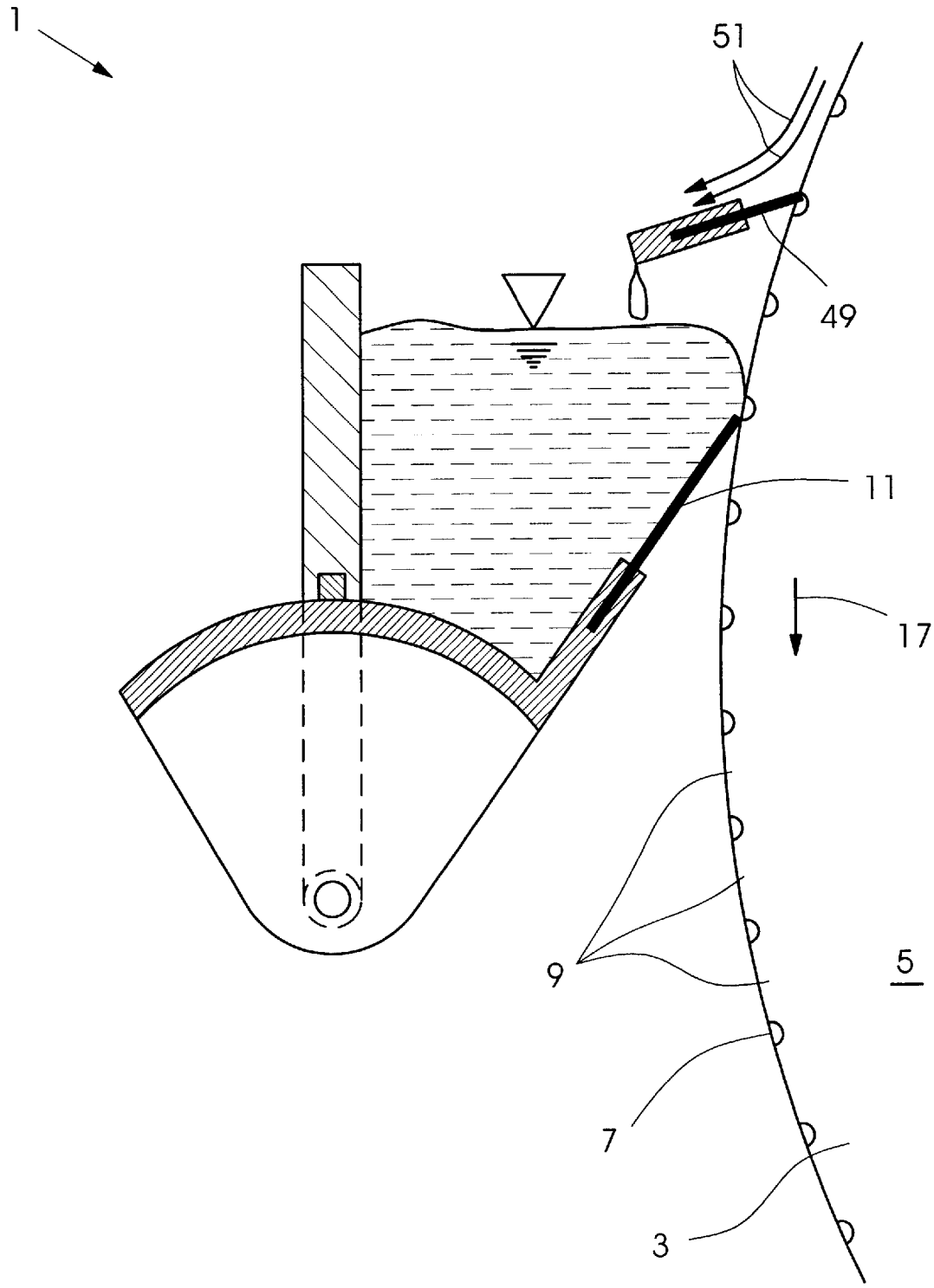
FIG. 7 is a view like those of FIGS. 1 to 3, respectively, showing a further exemplary embodiment of the inking unit.

FIG. 7 shows a further exemplary embodiment of the inking unit 1, which differs from the inking unit described hereinbefore with regard to FIGS. 1 to 3 only in that the metering doctor blade 11 has a further doctor blade 49 disposed upline therefrom in the direction of rotation of the screen roller 5, the further doctor blade 49 serving for wiping or stripping off the air layer entrained by the screen roller surface at high machine speeds, before the outer jacket surface 7 of the screen roller 5 enters the printing ink, so that this air layer is not concomitantly entrained with the printing ink, which could lead to a disruption of the inking of the cells 9. The air layer 51 that is wiped off is represented by curved arrows. If printing ink on the outer jacket surface 7 of the screen roller 5 is also doctored off by the doctor blade 49, this ink can drip back into the ink container 13, which is directly under the doctor blade 49. The doctor blade 49 is held in the position illustrated in FIG. 7 by non-illustrated holding elements.

Figure 8:
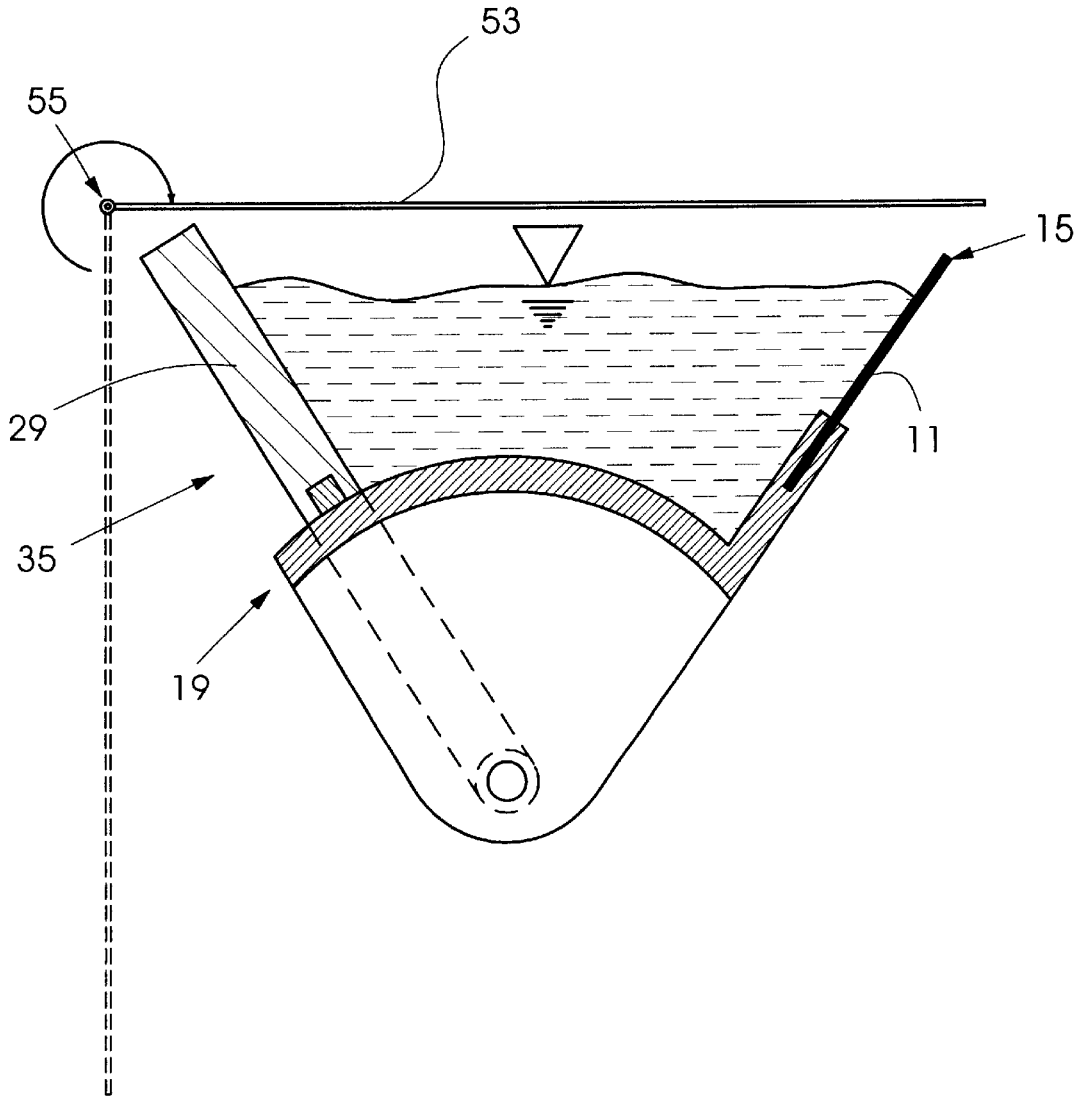
FIG. 8 is a fragmentary diagrammatic sectional view of an exemplary embodiment of an ink receptacle or container having a metering doctor blade disposed thereon.

In the exemplary embodiment shown in FIG. 7, the ink container 13 is partly covered on the open side thereof by the doctor blade 49. The remaining part of the ink container 13 is open at the top. In order to be able to close the ink container in the dismantled state, in the exemplary embodiment shown in 8, a cover 53 is provided which, by a hinge 55 provided on the ink container 13, can be folded over the open side of the ink container 13. The ink container 13 closed in this way, together with the printing ink remaining therein, can then be stored without allowing any dirt to fall into it. In addition, the cover 53 projecting beyond the tip 15 of the metering doctor blade 11 also protects the metering doctor blade 11, in particular, the tip 15 thereof, against damage. When it is installed in the inking unit 1, the cover 53 is folded away, so that it does not disrupt the printing operation. The cover 53 in the folded-away condition is illustrated in FIG. 8 with broken lines.

A common factor in all of the various constructions of the displacer element 35 or 35' is that it can extend over the entire width of the metering doctor blade 11. Alternatively, provision is made for the displacer element to extend over part of the length of the metering doctor blade 11.

The displacer elements described with regard to FIGS. 1 to 8 are, respectively, pivotably mounted and can be pivoted manually and/or by a suitable actuating device. Alternatively, in a non-illustrated exemplary embodiment, provision can be made for the displacer elements 35, 35' to be constructed so that they can be adjusted linearly. For this purpose, for example, a rectilinear guide can be used. The shape of the ink container 13 is appropriately adapted to the linear adjustment of the displacer element.

In summary, it remains to be noted that, by using the displacer element 35 or 35', the volume of the ink container can be changed specifically, so that a desired printing ink level in the ink container is set, and can be raised and lowered with respect to the tip 15 of the metering doctor blade 11, with the same printing ink filling quantity, by an adjustment of the displacer element.

In the exemplary embodiments of the inking unit 1 described with regard to FIGS. 1 to 8, when the ink container 13 is installed and during the operation of the inking unit 1, respectively, the metering doctor blade 11 is located in the region between the 7 o'clock position and the 11 o'clock position, namely, in approximately the 9 o'clock position, in relation to the screen roller 5. The ink container 13 and the metering doctor blade 11 are thus arranged laterally beside the screen roller 5.

The inking unit 1 according to the invention offers the advantage, amongst others, that, in order to dismantle the ink container 13 and the metering doctor blade 11, the ink container 13 does not have to be moved into a removal position, as is contemplated or provided for in the case of heretoforeknown devices of this general type.

I claim:

1. An inking unit for a printing machine, comprising at least one roller, an ink container adjacent to said roller, a metering doctor blade disposed on said ink container and being engageable with said roller, and a movable displacer element for setting a printing ink level in said ink container relative to said metering doctor blade, said displacer element being optionally adjustable into a first position corresponding to said printing ink level in said ink container lying above a highest point of said metering doctor blade, and into a second position corresponding to said printing ink level in said ink container lying below said highest point of said metering doctor blade.

2. The inking unit according to claim 1, wherein said displacer element is formed by an adjustable rear wall of said ink container.

3. The inking unit according to claim 2, wherein said rear wall is pivotably mounted.

4. The inking unit according to claim 3, wherein said rear wall is pivotably mounted on a base body carrying said metering doctor blade.

5. The inking unit according to claim 3, wherein said pivotable mounting is on a pivot axis located below a highest point of said metering doctor blade.

6. The inking unit according to claim 2, wherein said rear wall has a crank-shaped course.

7. The inking unit according to claim 1, wherein, in said first position thereof, said displacer element is at least partly immersed in the printing ink stored in said ink container, and in said second position thereof, is lifted completely out of said stored printing ink.

8. The inking unit according to claim 7, wherein said displacer element is pivotable about a pivot axis disposed above a bottom of said ink container.

9. The inking unit according to claim 7, wherein said displacer element has an outer contour matched to an inner contour of said ink container so that a height of a gap formed between at least one of an ink container rear wall and an ink container bottom, on the one hand, and said displacer element moved into an end position, on the other hand, is very small.

10. The inking unit according to claim 1, wherein said metering doctor blade, in a position thereof wherein it is in engagement with said roller, is disposed, in relation to said roller, below an upper apex and above a lower apex of said roller.

11. The inking unit according to claim 10, wherein said metering doctor blade is disposed in a region of said roller between 7 o'clock and 11 o'clock positions thereon.

12. The inking unit according to claim 1, wherein, as viewed in the direction of rotation of said roller, at least one further doctor blade is disposed upline from said metering doctor blade, said further doctor blade being settable in engagement with said roller and serving as a wiper for at least one of air and printing ink.

13. The inking unit according to claim 1, wherein said ink container is trough-shaped, and a cover is disposed on said ink container for closing said ink container.

* * * * *